US008852427B2

(12) United States Patent
Yeganeh et al.

(10) Patent No.: US 8,852,427 B2
(45) Date of Patent: Oct. 7, 2014

(54) METHOD AND SYSTEMS TO REMOVE POLAR MOLECULES FROM REFINERY STREAMS

(75) Inventors: Mohsen S. Yeganeh, Hillsborough, NJ (US); Peter W. Jacobs, Bound Brook, NJ (US); Ian A. Cody, Adelaide (AU); Steven W. Levine, Flemington, NJ (US); Eric B. Sirota, Flemington, NJ (US); Ramesh Gupta, Berkley Heights, NJ (US); Walter Weissman, Basking Ridge, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1043 days.

(21) Appl. No.: 12/894,335

(22) Filed: Sep. 30, 2010

(65) Prior Publication Data

US 2011/0139687 A1 Jun. 16, 2011

Related U.S. Application Data

(60) Provisional application No. 61/286,162, filed on Dec. 14, 2009.

(51) Int. Cl.

| | |
|---|---|
| ***C10G 25/00*** | (2006.01) |
| ***C10G 25/06*** | (2006.01) |
| ***C10G 25/12*** | (2006.01) |
| ***C10G 29/04*** | (2006.01) |
| ***C10G 29/16*** | (2006.01) |
| ***C10G 45/16*** | (2006.01) |

(52) U.S. Cl.

CPC ..... *C10G 25/06* (2013.01); *C10G 2300/202* (2013.01); *C10G 25/12* (2013.01); *C10G 25/003* (2013.01); *C10G 2300/206* (2013.01)

USPC ..... 208/254 R; 208/177; 208/250; 208/253; 208/263; 208/299; 208/305; 208/309

(58) Field of Classification Search

USPC ..... 208/177, 250, 253, 254 R, 263, 299, 208/305, 309

See application file for complete search history.

(56) References Cited

U.S. PATENT DOCUMENTS

| | | | | |
|---|---|---|---|---|
| 4,322,394 | A * | 3/1982 | Mezey et al. | 423/244.11 |
| 4,427,550 | A * | 1/1984 | Priestley | 210/675 |
| 6,835,303 | B2 * | 12/2004 | Mahajan | 208/208 R |
| 2003/0102255 | A1 | 6/2003 | Mahajan | |

FOREIGN PATENT DOCUMENTS

| | | | |
|---|---|---|---|
| EP | 1550505 | A1 | 7/2005 |
| WO | 2008030540 | A2 | 3/2008 |

OTHER PUBLICATIONS

X. Chen et al., Synthesis of Highly Selective Magnetic Mesoporous Adsorbent, 113 J. Phys. Chem. 9804-9813 (2009).*

A. Ghauch et al., Antibiotic Removal from Water: Elimination of Amoxicillin and Ampicillin by Microscale and Nanoscale Iron Particles, 157 Environ. Pollut. 1626-1635 (2009).*

W. Li et al., Ultra-Deep Desulfurization Adsorbents for Hydrotreated Diesel with Magnetic Mesoporous Aluminosilicates, 56 Aiche J. 1391-1396 (2010).*

PCT/US2010/058829, PCT International Search Report, Form PCT/ISA/210, dated Jun. 30, 2011, 3 pgs.

PCT/US2010/058829, PCT Written Opinion of the International Searching Authority, Form PCT/ISA/237, dated Jun. 30, 2011, 6 pgs.

* cited by examiner

*Primary Examiner* — Randy Boyer

(74) *Attorney, Agent, or Firm* — Glenn T. Barrett; Malcolm D. Keen

(57) ABSTRACT

The present invention relates to methods and systems for removing polar molecule contaminants from a refinery stream in connection with the processing of hydrocarbon fluids, chemicals, whole crude oils, blends and fractions in refineries and chemical plants that include adding high surface energy and/or high surface area nanoparticle compounds to a refinery stream to remove the polar molecule contaminants.

19 Claims, 7 Drawing Sheets

METHOD AND SYSTEMS TO REMOVE POLAR MOLECULES FROM REFINERY STREAMS

CROSS REFERENCE TO RELATED APPLICATION

This application relates to and claims priority to U.S. Provisional Patent Application No. 61/286,162, filed on Dec. 14, 2009, entitled "Methods and Systems to Remove Polar Molecules From Refinery Streams."

FIELD OF THE INVENTION

The present invention relates to methods and systems for removing polar molecule contaminants from a refinery stream in connection with the processing of chemicals and hydrocarbon fluids in refineries and chemical plants that includes adding high surface energy and/or high surface area nanoparticle compounds to a refinery stream to remove the polar molecule contaminants therein.

BACKGROUND OF THE INVENTION

Petroleum is an extremely complex mixture and consists predominantly of hydrocarbons, as well as compounds containing nitrogen, oxygen, and sulfur. Most petroleums also contain minor amounts of nickel and vanadium. The chemical and physical properties of petroleum vary considerably because of variations in petroleum composition.

Gasoline is a complex mixture of hydrocarbons. Commercial gasolines are blends of straight-run, cracked, reformed, and natural gasolines. Straight-run gasoline is recovered from crude petroleum by distillation and contains a large proportion of normal hydrocarbons of the paraffin series. Cracked gasoline is manufactured by heating crude-petroleum distillation fractions or residues under pressure, or by heating with or without pressure in the presence of a catalyst. Heavier hydrocarbons are broken into smaller molecules, some of which distill in the gasoline range. Reformed gasoline is made by passing gasoline fractions over catalysts in such a manner that low-octane-number hydrocarbons are molecularly rearranged to high-octane-number components. Many of the catalysts use platinum and other metals deposited on a silica and/or alumina support. Natural gasoline is obtained from natural gas by liquefying those constituents which boil in the gasoline range either by compression and cooling or by absorption in oil. During the production of gasoline, the processing of crude petroleum products can become fouled with contaminants, including polar molecule contaminants.

Many polar organic compounds such as S-containing molecules, naphthenic acid, asphaltene, porphyrin, and N-containing molecules add negative value to oil and its products. The negative value is associated with the costly refining and processing of these polar molecules due to their role played in corrosion, fouling, catalyst poisoning, and emissions. Therefore, safe and cost effective removal of polar molecules from hydrocarbon and chemical streams significantly increases energy savings and process profitability.

One method to remove polar molecules from a fluid is to flow the liquid through a fixed bed of particles which adsorb the polar molecules. However, a fixed bed process generally precludes the use of very small adsorbent particles that are less than 0.5 or 1.0 mm in size because of the excessive pressure drop that will result in a commercial process when such particles are used. This high pressure drop becomes even a bigger concern if the fixed bed fouls and plugs up.

Additionally, a fixed bed process requires periodic regeneration of the fixed bed following use, which is difficult and costly to achieve. For example, a high temperature is required to regenerate the fixed bed such that the bed is again able to adsorb particle contaminants. Due to the poor thermal conductivity and large size (e.g., several feet in diameter) of commercial fixed beds, regeneration usually requires heating the bed for several hours to achieve a temperature high enough to regenerate the bed. The time periods required for regeneration of fixed beds thus results in an industrial operation that is not practical or economical.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with one aspect of the invention, the present invention provides a method for removing a polar molecule contaminant from a refinery stream. The method includes the steps of providing a refinery stream containing a polar molecule contaminant, introducing a magnetic nanoparticle compound into the refinery stream, in which the polar molecule contaminant is adsorbed onto the nanoparticle compound to form a nanoparticle compound-polar molecule complex and separating the nanoparticle compound-polar molecule complex from the refinery stream. The polar molecule contaminant can be, for example, a sulfur-containing compound, nitrogen-containing compound, porphyrin, asphaltene, naphthenic acid, mercury, carbon dioxide and/or particulates. The magnetic nanoparticle can comprise any material that can be attracted to a magnetic field, for example, but not limited to, iron, nickel, cobalt and/or magnetite. In one embodiment, the refinery stream is a liquid or fluid hydrocarbon stream in a hydrocarbon refining process. Separating the nanoparticle compound-polar molecule complex can be accomplished, for example, by applying a magnetic field to the nanoparticle compound-polar molecule complex to separate the complex from the hydrocarbon liquid fluid.

In accordance with one embodiment, the method of the present invention further includes a step of regenerating the nanoparticle compound following the separation step to remove the polar molecule contaminant adsorbed onto the nanoparticle compound. In one embodiment, regenerating the nanoparticle compound can be achieved by heating the nanoparticle compound-polar molecule complex at a temperature of at least about 250° C. or by immersing the nanoparticle compound-polar molecule complex in water.

In accordance with another embodiment, the method of the present invention further includes decreasing the size of the nanoparticle compound prior to introducing the nanoparticle compound into the refinery stream (e.g., a hydrocarbon fluid) to increase the nanoparticle compound's capacity to remove polar molecule contaminants from the refinery stream.

In accordance with another embodiment, the method of the present invention further includes heating the nanoparticle compound prior to introducing the nanoparticle compound into the refinery stream (e.g., a hydrocarbon fluid) to increase the nanoparticle compound's capacity to remove polar molecule contaminants from the refinery stream.

Another aspect of the present invention includes a system for removing polar contaminates from a refinery stream (e.g., a hydrocarbon fluid). The system includes a refinery stream (e.g., a hydrocarbon fluid process stream) containing a polar molecule contaminant, a supply of a magnetic nanoparticle compound to be introduced to the refinery stream. The polar molecule contaminant is capable of being adsorbed onto the nanoparticle compound to form a nanoparticle compound-polar molecule complex. The system also includes a separator in fluid communication with the refinery stream for separating the nanoparticle compound-polar molecule complex from the refinery stream. The separator can include a magnetic field.

These and other features of the present invention will become apparent from the following detailed description of preferred embodiments which, taken in conjunction with the accompanying drawings, illustrate by way of example the principles of the present invention.

BRIEF DESCRIPTION OF THE DRAWINGS

The invention will now be described in conjunction with the accompanying drawings in which.

DETAILED DESCRIPTION OF THE INVENTION

Figure 1:
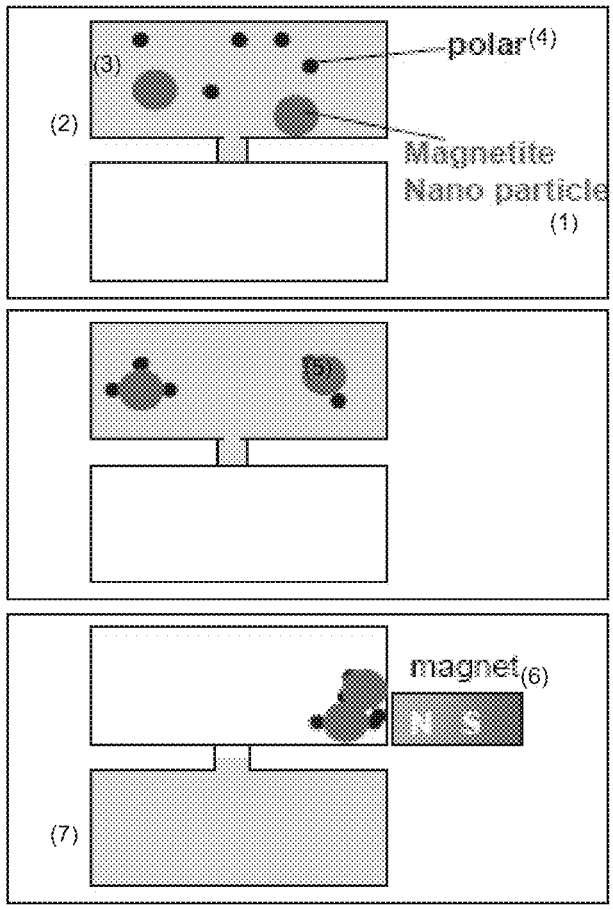
FIG. 1 shows a schematic of an exemplary apparatus that can be used to remove polar molecule contaminants (4) using magnetite nanoparticles (1), which are introduced into a first tank (2) containing a fluid (3) comprising the polar molecule contaminants (4). A nanoparticle compound-polar molecule complex is shown in (5), wherein a polar molecule compound is adsorbed onto the surface of the magnetite nanoparticle. The nanoparticle compound-polar molecule complex is attracted to a magnet (6) which exerts a magnetic force on the nanoparticle compound-polar molecule complex. A fluid with reduced amounts of a polar molecule contaminant is drained into a second tank (7).

As used herein, the term "refinery stream" generally refers to an apparatus or instrumentality of a chemical process (e.g., a process to refine crude hydrocarbons), such as an oil refinery process, which is, or can be, susceptible to contamination with a polar molecule. Refinery streams include, but are not limited to, processing streams in connection, or fluid communication with, heat transfer components such as a heat exchanger, a furnace, a crude preheater, a coker preheater, or any other heaters, a FCC slurry bottom, a debutanizer exchanger/tower, other feed/effluent exchangers and furnace air preheaters in refinery facilities, flare compressor components in refinery facilities and steam cracker/reformer tubes in petrochemical facilities. Refinery streams can also be in connection, or in fluid communication with, other instrumentalities in which heat transfer can take place, such as a fractionation or distillation column, a scrubber, a reactor, a liquid-jacketed tank, a pipestill, a coker and a visbreaker. Refinery streams can also be in connection, or in fluid communication with, tubes, piping, baffles and other process transport mechanisms that are internal to, at least partially constitute, and/or are in fluid communication with, any one of the above-mentioned components. It is understood that the term refinery stream includes, but is not limited to, process streams in connection with chemical processes besides petrochemical refining operations.

As used herein, the terms "hydrocarbon fluid" or "hydrocarbon liquid fluid" refer to a fluid composition containing at least predominately compounds comprising hydrogen and carbon. Such compounds include, for example, saturated alkanes, and/or unsaturated alkenes and alkynes. A hydrocarbon fluid can also include cycloalkanes, cycloalkenes and cycloalkynes. Furthermore, a hydrocarbon fluid can include aromatic hydrocarbons or arenes, alkanes, alkenes and alkyne-based compounds. The hydrocarbon compounds can be unsubstituted or substituted with additional chemical groups.

As used herein, the term "polar molecule contaminant" refers to any polar compound present in a refinery stream that has a surface affinity for high surface energy compounds, wherein the polar molecule contaminant adsorbs onto the surfaces of such high surface energy compounds.

As used herein, the term "nanoparticle compound" refers to a compound with high surface energy and/or high surface area, as described in more detail below, wherein the surface of the compound has the capacity to adsorb polar molecules.

Reference will now be made in detail to the various aspects of the present invention. The method and corresponding steps of the invention will be described in conjunction with the figures and examples provided herein.

In accordance with the present invention, a method for reducing polar molecule contaminants in a refinery stream is provided. This reduction in contaminants is achieved by adding an amount of a nanoparticle compound to a refinery stream effective to remove the polar molecule contaminants, wherein the polar molecule contaminants are adsorbed onto the nanoparticle compound, and separating the nanoparticle compound-polar molecule complex from the refinery stream. The nanoparticle compound can be added to the refinery stream in separate batches, or in a continuous refinery stream.

In accordance with another embodiment of the invention, the refinery stream includes a hydrocarbon fluid. For example, the refinery stream can be in connection with a petrochemical refinery operation. In another embodiment of the invention, the nanoparticle compound is introduced to be freely dispersed within the hydrocarbon fluid.

In accordance with another aspect of the present invention, a system is provided that is capable of removing polar contaminates from a refinery stream. The system includes at least one fluid, solution, solvent or mixtures thereof, containing a polar molecule contaminant; a supply of a nanoparticle compound to be introduced to the refinery stream, wherein the polar molecule contaminant is capable of being adsorbed onto the nanoparticle compound to form a nanoparticle compound-polar molecule complex; and a separator in fluid communication with the refinery stream for separating the nanoparticle compound-polar molecule complex from the refinery stream.

In accordance with the invention, the addition of an amount of a nanoparticle compound to a refinery stream effective to adsorb a polar molecule contaminant to form a nanoparticle compound-polar molecule complex, and separation of the nanoparticle compound-polar molecule complex from the refinery stream is effective in reducing contamination of the refinery stream. While not limited thereto, the addition of a nanoparticle compound according to the methods of the invention is particularly suitable in reducing or preventing polar molecule contamination.

In accordance with one embodiment of the invention, the polar molecule contaminants include organic and inorganic particulates. Organic particulates (such as precipitated asphaltenes and coke particles) include, but are not limited to, insoluble matter precipitated out of solution upon changes in process conditions (e.g. temperature, pressure, or concentration changes) or a change in the composition of the refinery stream (e.g. changes due to the occurrence of a chemical reaction). Inorganic particulates include, but are not limited to, silicon dioxide, clay and iron oxide.

In accordance with another embodiment of the invention, a polar molecule contaminant includes, but is not limited to, sulfur-containing compounds, nitrogen-containing compounds, porphyrin, asphaltene, naphthenic acid, mercury, carbon dioxide and particulates.

In accordance with another embodiment of the present invention, the nanoparticle compound is added to a refinery stream, for example, a hydrocarbon fluid, which contains polar molecule contaminants, including organic and inorganic particulates as defined above. The refinery stream can contain any amount of particulates, such as, for example, 1-10,000 ppm.

In accordance with one embodiment of the invention, the nanoparticle compound is a compound comprising a high surface energy. Generally, surface energy quantifies the disruption of intermolecular bonds that occurs when a surface is created, wherein the surface of a compound is less energetically favorable than the remainder of the compound. In accordance with one embodiment of the invention, the surface energy of the nanoparticle compound is at least about 10 $mJ/m^2$, at least about 20 $mJ/m^2$, at least about 30 $mJ/m^2$, at least about 40 $mJ/m^2$, at least about 50 $mJ/m^2$, at least about 60 $mJ/m^2$, at least about 70 $mJ/m^2$, at least about 80 $mJ/m^2$, at least about 90 $mJ/m^2$, or at least about 100 $mJ/m^2$.

In accordance with one embodiment of the invention, the nanoparticle compound has a diameter of from about 0.01 to about 1000 nm, more preferably from about 1 to about 60 nm, and more preferably from about 1 to about 10 nm. In one embodiment, the nanoparticle compound has a diameter of from about 40-60 nm. In other embodiments, the nanoparticle compound has a diameter of about 3 nm.

In yet another embodiment of the invention, the nanoparticle compound has a diameter of about 1 mm or less. In other embodiments of the invention, the nanoparticle compound has a diameter of about 0.5 mm or less.

Without being bound to any theory, it is believed that the capacity of a unit mass of nanoparticle compound to adsorb a polar molecule contaminant increases as the surface area of the unit mass of nanoparticle compound is increased. In accordance with one embodiment, the present invention includes a method of increasing the capacity of a nanoparticle compound to adsorb a polar molecule contaminant by decreasing the size of the nanoparticle compound, for example, as measured by the nanoparticle compound diameter. For example, the size of the nanoparticles comprising a unit mass of nanoparticle compound can be decreased, thereby increasing the adsorbent capacity of the unit mass of nanoparticle compound. In one embodiment, the methods of the invention include decreasing the size of the nanoparticle compound prior to introducing the nanoparticle compound into a refinery stream, for example, a hydrocarbon fluid, to increase the nanoparticle compound's capacity to remove polar molecule contaminants from the refinery stream.

In other embodiments of the invention, heating the nanoparticle compound prior to introducing the nanoparticle compound into a refinery stream, for example, hydrocarbon fluid, increases the nanoparticle compound's capacity to remove polar molecule contaminants from the refinery stream. In one embodiment of the invention, the nanoparticle compound is heated at a temperature of from about 100° C. to about 1000° C., or from about 100° C. to about 750° C., or from about 100° C. to about 500° C., or from about 100° C. to about 200° C. In other embodiments of the invention, the nanoparticle compound is heated at a temperature of at least about 250° C. In yet other embodiments of the invention, the nanoparticle compound is heated at a temperature of at least about 350° C.

In other embodiments of the invention, the nanoparticle compound is heated prior to introducing the nanoparticle compound into a refinery stream, for example, hydrocarbon fluid, at a temperature up to the magnetic phase transition temperature of the nanoparticle, or a magnetic compound present in the nanoparticle.

In other embodiments, the nanoparticle compound is heated prior to introducing the nanoparticle compound into a refinery stream, for example, hydrocarbon fluid, at a temperature above about 250° C. and below the magnetic phase transition temperature of the nanoparticle, or a magnetic compound present in the nanoparticle. In one non-limiting example, when the magnetic compound is magnetite, the nanoparticle can be heated at a temperature, for example, between about 250° C. and 585° C.

In accordance with one embodiment of the invention, the nanoparticle compound has a surface area from at least about 0.5-1000 $m^2/g$, from at least about 1-750 $m^2/g$, from at least about 5 to 500 $m^2/g$, from at least about 7-400 $m^2/g$, from at least about 15-200 $m^2/g$ as measured by nitrogen BET.

In accordance with one embodiment of the invention, the nanoparticle compound has a surface area from at least about 10-300 $m^2/g$ as measured by nitrogen BET.

In accordance with another embodiment of the invention, the nanoparticle compound can be introduced into a refinery stream, for example, a hydrocarbon fluid, at an acidic pH (for example, a pH that is less than pH 7.0), a neutral pH (for example, at about pH 7.0), or at a basic pH (for example, a pH greater than pH 7.0). In one embodiment of the invention, the nanoparticle compound is introduced into the refinery stream at a pH greater than 1.0.

As encompassed by the present invention, the nanoparticle can be introduced into a refinery stream, adsorb a polar molecule contaminant onto its surface, and be separated from the refinery stream without changing the temperature of the refinery stream, for example, a hydrocarbon fluid. Thus, in accordance with one embodiment, the methods of the invention includes maintaining a temperature of a refinery stream following introduction of the nanoparticle compound at a similar temperature as prior to the introduction of the nanoparticle compound. In other embodiments of the invention, the temperature of the refinery stream is increased or decreased before, after, or at the same time as the nanoparticle is introduced into the refinery stream. This is in contrast to prior art methods, for example, methods of removing contaminants using fixed bed assemblies, which require temperature changes in removing contaminants from a refinery stream.

In one embodiment, the nanoparticle is introduced into a hydrocarbon stream at a temperature up to the magnetic phase transition temperature of the nanoparticle, or a magnetic compound present in the nanoparticle. In one non-limiting example, when the magnetic compound is magnetite, the nanoparticle can be introduced into a hydrocarbon stream at a temperature up to, for example, about 585° C.

As encompassed by the present invention, the nanoparticle compound can be introduced into a refinery stream, for example a hydrocarbon fluid, adsorb a polar molecule compound onto its surface, and be separated from the refinery stream without changing the pressure of the refinery stream. Thus, in accordance with one embodiment, the methods of the invention further include maintaining a pressure of the refinery stream following introduction of the nanoparticle compound at a similar pressure as before the introduction of the nanoparticle compound. In other embodiments of the invention, the pressure of the refinery stream is increased or decreased before, after, or at the same time as the nanoparticle compound is introduced into the refinery stream. This is in contrast to prior art methods, for example, methods of removing contaminants using fixed bed assemblies, which require pressure changes in the refinery stream to remove the contaminants.

As contemplated by the present invention, the nanoparticle compound is introduced into a refinery stream, for example, a hydrocarbon fluid, in an amount effective to remove a polar molecule contaminant from the refinery stream. In one non-limiting embodiment, the nanoparticle compound is introduced into the refinery stream at a concentration of from about 0.01 weight % to about 99 weight %, from about 0.01 weight % to about 90 weight %, from about 0.01 weight % and 80 weight %, from about 0.01 weight % to about 70 weight %, from about 0.01 weight % to about 60 weight %, from about 0.01 weight % to about 50 weight %, from about 0.01 weight % to about 40 weight %, from about 0.01 weight % to about 30 weight %, from about 0.01 weight % to about 20 weight %, from about 0.01 weight % to about 10 weight %, from about 0.01 weight % to about 5 weight %, or from about 0.01 weight % to about 1 weight % of the refinery stream.

In one non-limiting embodiment, the nanoparticle compound is introduced into the refinery stream at a concentration of from about 0.1 to about 15 weight % of the refinery stream.

In one embodiment of the invention, the nanoparticle compound is introduced into the refinery stream, for example, a hydrocarbon fluid, at a concentration of 10 weight % of the refinery stream. In other embodiments, the nanoparticle compound is introduced into the refinery stream at a concentration of 1 weight % of the refinery stream.

In accordance with another embodiment of the invention, the nanoparticle compound is introduced into a refinery stream, for example, a hydrocarbon fluid, in amount effective to reduce the concentration of polar molecule contaminants in the refinery stream. In one embodiment, the amount of nanoparticle compound introduced into the refinery stream is effective to reduce the concentration of polar molecule contaminants in the refinery stream from about 0% to 100%, or from about 0 to about 90%, or from about 0 to about 80%, or from about 0 to about 70%, or from about 0 to about 60%, or from about 0 to about 50%, or from about 0 to about 40%, or from about 0 to about 30%, or from about 0 to about 20%, or from about 0 to about 10%, or from about 0 to about 5%, or from about 0 to about 1%.

In accordance with one embodiment of the invention, the nanoparticle compound is a magnetic compound. Because the compound is magnetic, and can be attracted or repelled by a magnetic field, the nanoparticle compound of the invention, and/or the nanoparticle compound-polar molecule complex, can be separated from a refinery stream, for example, a hydrocarbon fluid, by applying a magnetic field to the nanoparticle compound and/or the nanoparticle compound-polar molecule complex.

In accordance with another embodiment of the invention, the nanoparticle compound can comprise any material that can be attracted to a magnetic field, for example, but not limited to, iron, nickel, cobalt, magnetite or mixtures thereof.

In accordance with another embodiment of the invention, the nanoparticle compound can be separated from the refinery stream, for example, a hydrocarbon fluid, by applying a magnetic field to the nanoparticles. In one embodiment, the nanoparticle compound has a polar molecule contaminant adsorbed on its surface to form a nanoparticle compound-polar molecule complex. In other embodiment, the polar molecule contaminant is absorbed into the nanoparticle compound to form a nanoparticle compound-polar molecule complex. The magnetic field can attract or repel the nanoparticle compound-polar molecule complex to or away from the magnetic source so that the nanoparticle compound-polar molecule complex can be collected and removed from the refinery stream. The magnetic field can be produced by any means known in the art.

According to one embodiment, separating the nanoparticle compound-polar molecule complex from a refinery stream, for example, a hydrocarbon fluid, includes applying a magnetic field to the nanoparticle compound-polar molecule complex to separate the complex from the hydrocarbon liquid fluid.

In one embodiment, the nanoparticle compound or the nanoparticle compound-polar molecule complex can be separated from a refinery stream in the absence of a filter. In other embodiments, a filter is present.

In other embodiments of the invention, a nanoparticle compound-polar molecule complex can be removed from a fluid by passing the fluid comprising the nanoparticle compound-polar molecule complex through an apparatus, such as, but not limited to, a packing or filter that is magnetized, for example, by an electric current or an electromagnetic field. By passing the fluid through the magnetic apparatus, the nanoparticle compound-polar molecule complex can be attracted to or repelled from the apparatus, thereby removing the nanoparticle compound-polar molecule complex from the fluid passed through the apparatus. When the nanoparticle compound-polar molecule complex is attracted to the apparatus, the magnetic field can be turned off periodically to dislodge the nanoparticle compound-polar molecule complex attached to the apparatus. In yet other embodiments, the apparatus is not magnetized, and the nanoparticle compound-polar molecule complex is separated from the fluid by a physical interaction with the apparatus, such that the fluid passes through or around the apparatus, while the nanoparticle compound-polar molecule complex is bound to the apparatus.

Furthermore, the addition of a nanoparticle compound to a refinery stream, as described in connection with the present invention, can be combined with other techniques for reducing and/or mitigating polar molecule contamination. Such techniques include, but are not limited to, fixed bed adsorption, as generally known in the art (see, e.g., U.S. Pat. Nos. 5,730,860 and 7,148,389, which are each hereby incorporated by reference in their entireties).

Following the removal of a nanoparticle compound-polar molecule complex from a refinery stream, for example, a hydrocarbon fluid, the nanoparticle compound can be regenerated to removed the polar molecule contaminants adsorbed onto the surface of the nanoparticle compound, and increase the nanoparticle compound's ability to adsorb additional polar molecule contaminants. In accordance with one embodiment, a nanoparticle compound of the present invention can be regenerated from a nanoparticle compound-polar molecule complex by heating the nanoparticle compound-polar molecule complex. In one embodiment, regenerating the nanoparticle compound includes heating the nanoparticle compound-polar molecule complex at a temperature of at least about 250° C.

In other non-limiting embodiments, a nanoparticle compound of the present invention can be regenerated from a nanoparticle compound-polar molecule complex by heating the nanoparticle compound-polar molecule complex at a temperature above about 250° C. and below the magnetic phase transition temperature of the nanoparticle, or the magnetic compound present in the nanoparticle. In one non-limiting example, when the magnetic compound is magnetite, the nanoparticle can be heated at a temperature, for example, between about 250° C. and 585° C.

In other embodiments of the invention, the nanoparticle compound can be regenerated from a nanoparticle compound-polar molecule complex by contacting the nanoparticle compound-polar molecule complex with water, or any other polar liquid or solution. In one embodiment, regenerating the nanoparticle compound includes immersing the nanoparticle compound-polar molecule complex in water.

Referring now to FIG. 1, there is shown an exemplary system and method according to one embodiment of the invention for removing a polar molecule contaminant from a fluid, for example, a hydrocarbon fluid. As shown in FIG. 1, magnetite nanoparticles (1) are introduced into a first tank (2) containing fluid (3) comprising polar molecule contaminants (4). The polar molecule contaminants are adsorbed onto the surface of the magnetite nanoparticles to form nanoparticle compound-polar molecule complexes (5). A magnetic force produced by a magnet (6) is then exerted on the nanoparticle compound-polar molecule complexes, thereby attracting the nanoparticle compound-polar molecule complexes towards the magnet, and the fluid removed from the first tank to a second tank (7), wherein the removed fluid is free from, or substantially free from, the nanoparticle compound-polar molecule complexes (5).

EXAMPLES

The present invention is further described by means of the examples, presented below. The use of such examples is illustrative only and in no way limits the scope and meaning of the invention or of any exemplified term. Likewise, the invention is not limited to any particular preferred embodiments described herein. Indeed, many modifications and variations of the invention will be apparent to those skilled in the art upon reading this specification. The invention is therefore to be limited only by the terms of the appended claims along with the full scope of equivalents to which the claims are entitled.

Example 1

Polar Molecule Contaminants have Affinity for High Energy Surfaces

Figure 2:
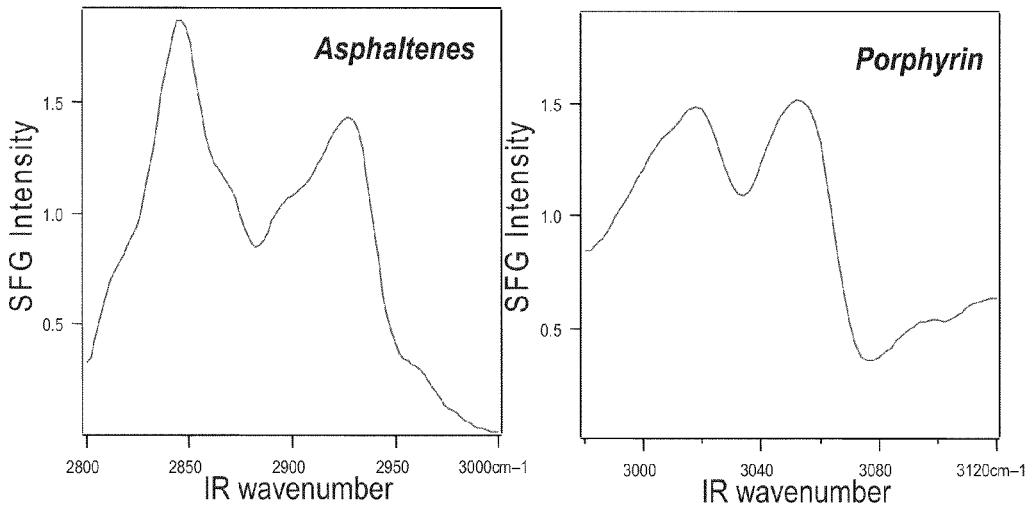
FIG. 2 shows the sum frequency generation (SFG) spectra of the interface between sapphire, a high surface energy material, and toluene that contains either asphaltene or porphyrine, as describe din Example 1.

Sum frequency generation (SFG) was used to examine the affinity of asphaltene or porphyrine for sapphire, a high energy surface. Sample of deuterated toluene that contain either asphaltene or porphyrine, two polar molecule contaminants, were contacted with sapphire. The SFG spectra of the interface between the sapphire and the toluene-asphaltene or toluene-porphyrine was generated. Deuterated toluene does not produce any spectral features in the 2800-3200 $cm^{-1}$ and the spectral structures shown in FIG. 2 are produced by asphaltene or porphyrine at the liquid/sapphire interface, indicating the adsorption of these two polar molecules onto the sapphire. This is concluded based on the fact that randomly oriented molecules at the interface do not produce any SFG signals. When molecules such as asphaltene and porphyrine adsorb onto the solid their random orientational arrangement is lifted and able to produce SFG signals. Therefore, the SFG resonance features in the spectra, shown in FIG. 2, are the signatures of adsorbed asphaltene and porphyrine onto the solid surface. This demonstrates that these polar molecules have strong affinity toward high surface energy materials, such a sapphire.

Example 2

Removal of Asphaltene from Toluene

Figure 3:
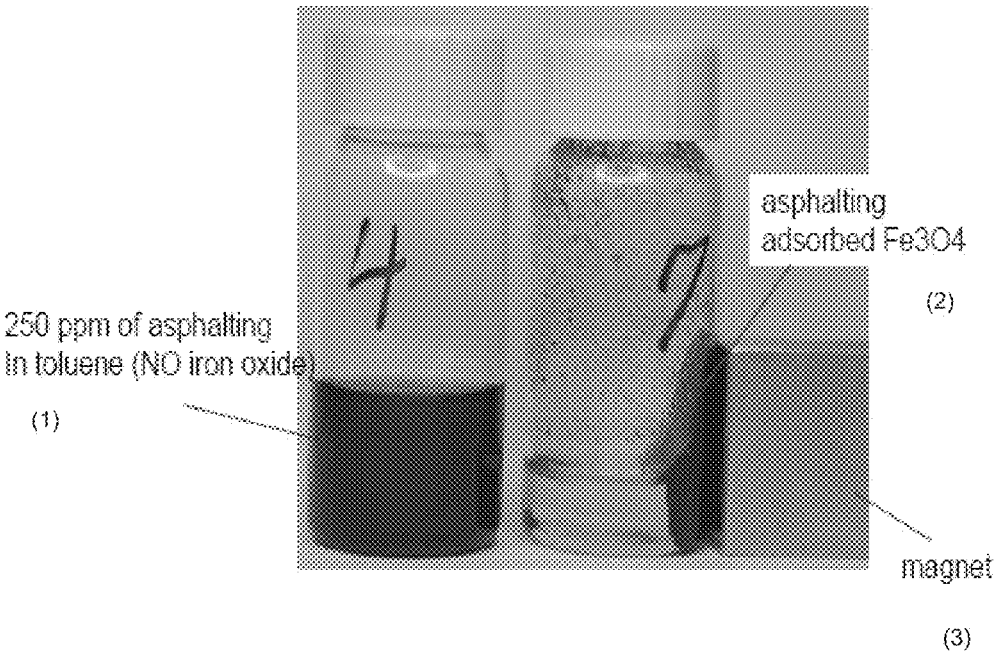
FIG. 3 shows a solution of 250 ppm asphaltene in toluene and a solution of 250 ppm asphaltene in toluene after being cleaned with 10 wt % of 40-60 nm magnetite nanoparticles, as described in Example 2.

A toluene solution containing 250 ppm of asphaltene (extracted from Arab light crude) was cleaned using 10 wt % of 40-60 nm magnetite particles. FIG. 3 shows a toluene solution containing 250 ppm asphaltene to which no magnetite nanoparticles have been added (1), and a toluene solution containing 250 ppm asphaltene to which the nanoparticles have been added (2). The magnetite nanoparticles with adsorbed asphaltene in (2) have been attracted to a magnet (3) which exerted an attractive magnetic force on the magnetite nanoparticles. FIG. 3 shows a reduction in asphaltene concentration only. The initial amounts of solvent in (1) and (2) were not identical, and the lower level of solution in (2) is not due to liquid uptake by the nanoparticles.

Example 3

Figure 4:
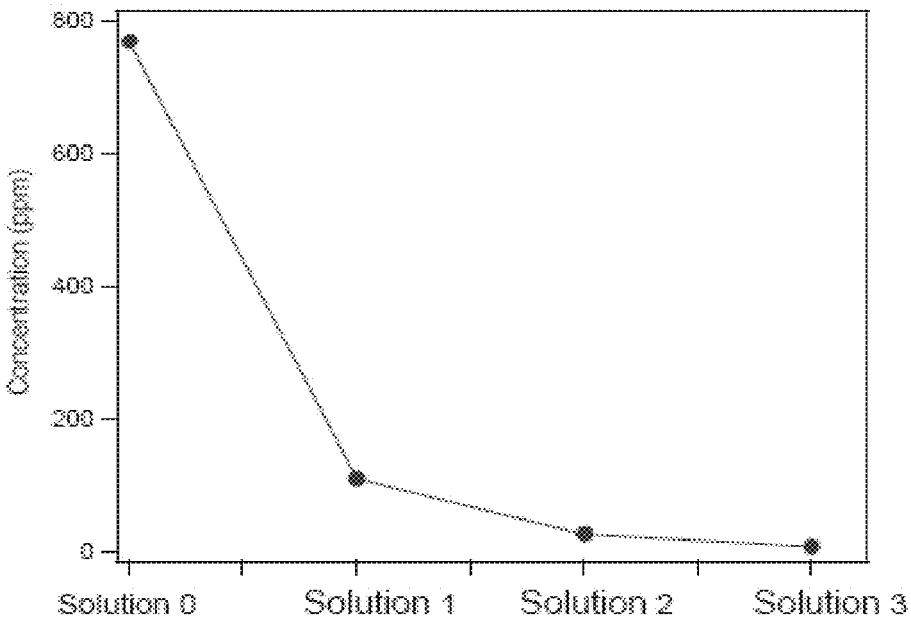
FIG. 4 is a graph illustrating the asphaltene concentration of a solution of 770 ppm asphaltene in toluene after repeated cleansings with 10 wt % of 40-60 nm magnetite nanoparticles, as described in Example 3.

Removal of Asphaltene from Toluene 770 ppm of asphaltene (extracted from Arab light crude) was prepared in toluene (FIG. 4, solution 0). 10 wt % of 40-60 nm magnetite nanoparticles were then added to the solution and kept in contact with the solution for approximately five minutes. The nanoparticles were removed using a magnet (FIG. 4, solution 1). 10 wt % of 40-60 nm magnetite nanoparticles were added to solution 1. After approximately five minutes the nanoparticles were removed using a magnet (FIG. 4, solution 2). 10 wt % of 40-60 nm magnetite nanoparticles were then added to solution 2. After approximately five minutes the nanoparticles were removed using a magnet (FIG. 4, solution 3). The UV-Vis transmission spectrum of each solution was collected and the absorption was calculated. Using the known value of the concentration of "solution 0" and the measured value of the total UV-Vis absorbance of each solution, the asphaltene concentration of each solution was determined. FIG. 4 depicts a graph showing the asphaltene concentration for each solution, demonstrating the removal of asphaltene using magnetite nanoparticles. The initial 770 ppm concentration of asphaltene was reduced by 87.5% after the first treatment with magnetic nanoparticles, and was reduced by about 100% after the second treatment with the magnetite nanoparticles.

Example 4

Figure 5:
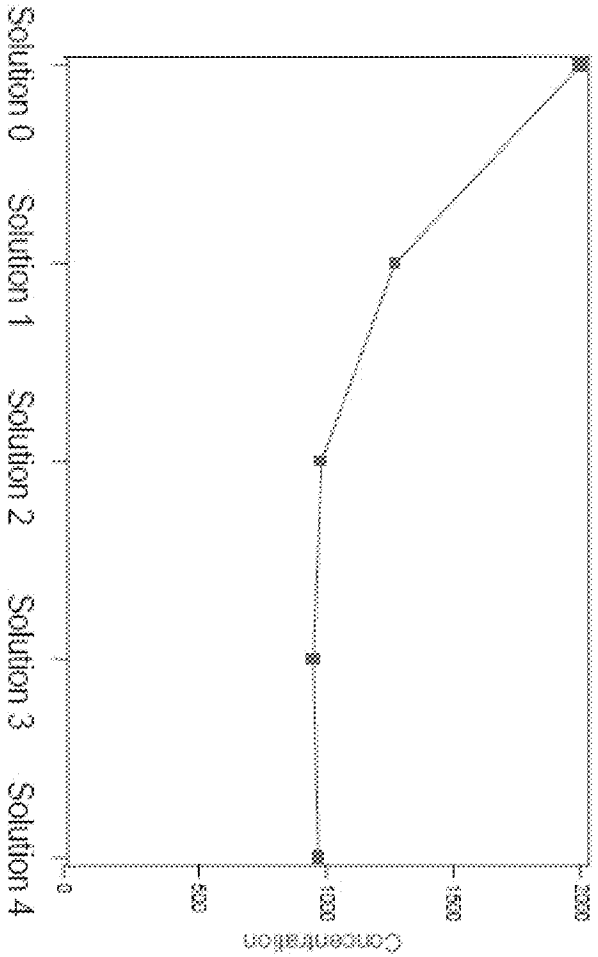
FIG. 5 is a graph illustrating the porphyrin concentration of a solution of 800 ppm porphyrin in toluene after repeated cleansings with 10 wt % of 40-60 nm magnetite nanoparticles, as described in Example 4.

Removal of Porphyrin from Toluene 800 ppm of porphyrin solution was prepared in toluene (FIG. 5, solution 0). 10 wt % of 40-60 nm magnetite nanoparticles were added to the solution and kept in contact with the solution for approximately five minutes. The nanoparticles were removed using a magnet (FIG. 5, solution 1). 10 wt % of 40-60 nm magnetite particles were then added to solution 1. After approximately five minutes the nanoparticles were removed using a magnet (FIG. 5, solution 2). 10 wt % of 40-60 nm magnetite particles were then added to solution 2. After approximately five minutes the nanoparticles were removed using a magnet (FIG. 5, solution 3). 10 wt % of 40-60 nm magnetite particles were then added to solution 1. After approximately five minutes the nanoparticles were removed using a magnet (FIG. 5, solution 4). The UV-Vis transmission spectrum of each solution was collected. Using the known value of the concentration of "solution 0" and the measured value of the total UV-Vis absorbance of each solution, the porphyrin concentration of each solution was determined. FIG. 5 depicts a graph showing the porphyrin concentration for each solution, demonstrating the removal of porphyrin using magnetite nanoparticles. The initial 800 ppm concentration of porphyrin was reduced by 37.5% after the first treatment with magnetite nanoparticles, and was reduced by about 50% after the second treatment with the magnetite nanoparticles. The concentration of porphyrin in solutions 3 and 4 remained at about 50% of solution 0 following treatment.

Example 5

Removal of Napthenic Acid

Figure 6:
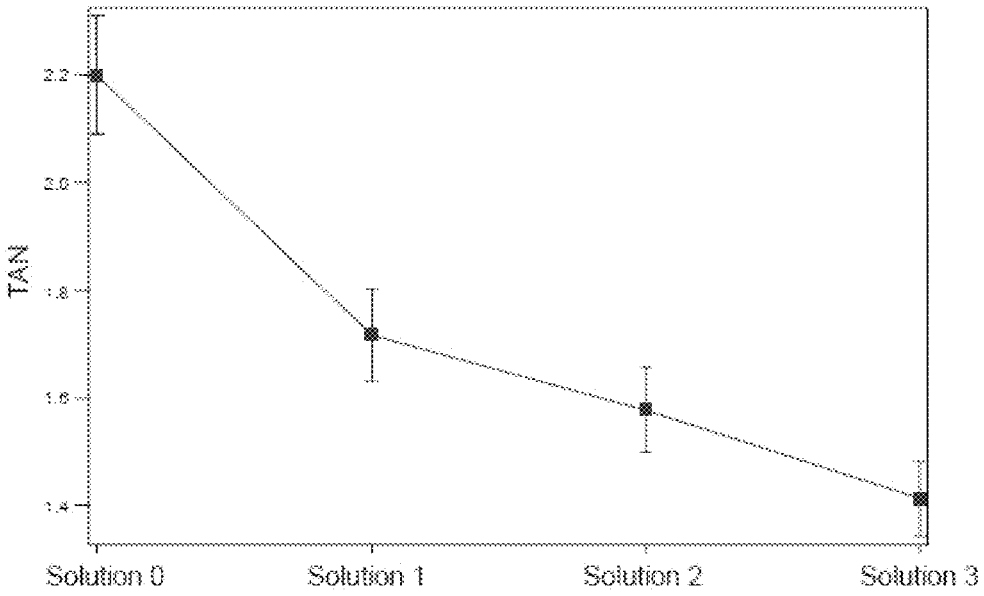
FIG. 6 is a graph illustrating the naphthenic acid concentration of a solution containing naphthenic acid with a TAN of 2.2 prepared in hexadecane after repeated cleansings with 10 wt % of 40-60 nm magnetite nanoparticles, as described in Example 5.

A solution containing naphthenic acid with a TAN of 2.2 was prepared in hexadecane (FIG. 6, solution 0). 10 wt % of 40-60 nm magnetite nanoparticles were then added to the solution and kept in contact with the solution for approximately five minutes. The nanoparticles were removed using a magnet (FIG. 6, solution 1). Next 10 wt % of 40-60 nm magnetite particles were added to solution 1. After approximately five minutes the nanoparticles were removed using a magnet (FIG. 6, solution 2). 10 wt % of 40-60 nm magnetite particles were then added to solution 2. After approximately five minutes the nanoparticles were removed using a magnet (FIG. 6, solution 3). The FTIR spectrum of each solution was collected. Using the known value of the concentration of "solution 0" and the measured value of the total absorbance of IR for the acid group of each solution, the naphthenic acid concentration of each solution was determined and TAN was calculated. FIG. 6 depicts a graph showing TAN for each solution, demonstrating the removal of naphthenic acid using magnetite nanoparticles. The initial concentration of naphthenic acid was reduced by 22.7% after the first treatment with magnetite nanoparticles, by about 27.2% after the second treatment with the magnetite nanoparticles, and by about 36.3% after the third treatment with magnetite nanoparticles.

Example 6

Nanoparticle Regeneration Using Heat

A solution containing 823 ppm of asphaltene (extracted from Heavy Arab crude) in toluene was prepared. 10 wt % of 40-60 nm magnetite nanoparticles were added to the solution. The nanoparticles were then separated from the solution with a magnet. Using the UV-vis spectrum of the original solution and the once-cleaned solution it was determined that 631 ppm of asphaltene was removed by the nanoparticles.

Following removal from the solution, the nanoparticles were left to dry overnight in an ambient environment and then placed in an air oven at 350° C. for one hour. The heat treated nanoparticles were then added to a freshly prepared solution of 823 ppm of asphaltene in toluene. After one minute the nanoparticles were removed from the solution using a magnet, and the UV-vis of the processed solution was recorded. The UV-vis spectrum reveals that 772 ppm was removed from the solution. Thus, the polar removal capability of magnetite nanoparticles can be restored using heat. Additionally, the polar molecule contaminant removal capability of the magnetite nanoparticles increases with heat treatment.

Example 7

Nanoparticle Regeneration Using Water

A solution containing 823 ppm of asphaltene (extracted from Heavy Arab crude) in toluene was prepared. 10 wt % of 40-60 nm magnetite nanoparticles were added to the solution. The nanoparticles were removed from the solution after approximately five minutes using a magnet. Using the UV-vis spectrum of the original solution and the once-cleaned solution, it was determined that 749 ppm of asphaltenes were removed by the nanoparticles. The removed nanoparticles were immersed in water for approximately five minutes. The nanoparticles were then separated from water using a magnet and left to dry in an ambient environment for 12 days. The water-treated nanoparticles were then added to a freshly prepared solution of 823 ppm of asphaltene in toluene. After approximately five minutes the nanoparticles were separated from the solution and the UV-vis of the processed solution was recorded. The UV-vis spectrum reveals that 644 ppm was removed from the solution. Thus, the polar removal capability of the magnetite nanoparticles can be restored by immersing used nanoparticles in water.

Example 8

Figure 7:
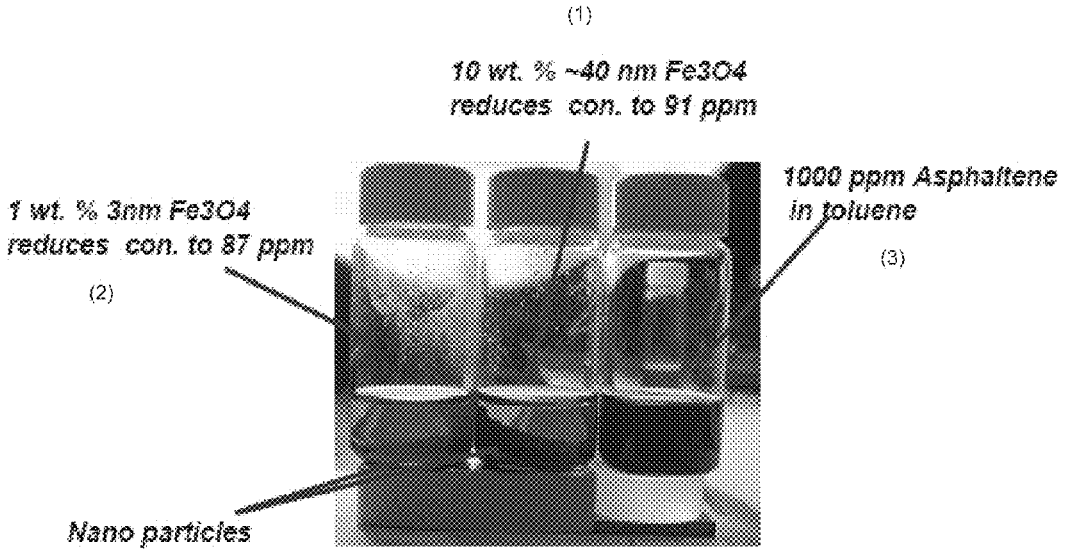
FIG. 7 shows three solutions of 1000 ppm asphaltene in toluene, wherein two of the solutions have been cleaned with either (a) 10 wt % of 40-60 nm magnetite nanoparticles or (b) 1 wt % of 3 nm magnetite nanoparticles, as shown in Example 8.

Reducing Nanoparticle Size Increases Polar Molecule Contaminant Removal Capacity Two equal amounts of 1000 ppm asphaltene (extracted from Heavy Arab crude) in toluene solution were prepared. In one solution 10 wt % of 40-60 nm magnetite nanoparticles were added. 1 wt % of 3 nm magnetite nanoparticles were added to the second solution. The nanoparticles were removed from the solutions after approximately five minutes using a magnet. The UV-Vis spectra of the cleaned solutions revealed that the concentration of asphaltene was reduced to 91 and 87 ppm, in the first and the second solution, respectively. FIG. 7 shows the nanoparticle-cleaned solutions to which 10 wt % of 40-60 nm magnetite nanoparticles (1) and to which 1 wt % of 3 nm magnetite nanoparticles were added (2). Alongside the two cleaned solutions is a 1000 ppm (uncleaned) reference solution (3).

* * *

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

Patents, patent applications, publications, product descriptions and protocols are cited throughout this application, the disclosures of which are incorporated herein by reference in their entireties for all purpose.

The invention claimed is:

1. A method for removing a polar molecule contaminant from a liquid hydrocarbon stream in a hydrocarbon refining process comprising:

(a) providing a the liquid hydrocarbon stream containing a polar molecule contaminant;

(b) introducing a magnetic nanoparticle compound having a surface energy of at least about 20 $mJ/m^2$ into the stream at a temperature up to the magnetic phase transition temperature of the nanoparticle compound and adsorbing, the polar molecule contaminant onto the nanoparticle compound to form a nanoparticle compound-polar molecule complex; and (c) applying a magnetic field to the nanoparticle compound-polar molecule complex to separate the complex from the liquid hydrocarbon stream.

2. The method of claim 1, wherein the polar molecule contaminant is selected from sulfur-containing compounds, nitrogen-containing compounds, porphyrin, asphaltene, naphthenic acid, mercury and carbon dioxide.

3. The method of claim 1, wherein the nanoparticle compound has a surface energy of at least about 70 mJ/m2.

4. The method of claim 1, wherein the nanoparticle compound has a surface area of from about 5 to 500 $m^2/g$ as measured by nitrogen BET.

5. The method of claim 4, wherein the nanoparticle compound has a surface area of from about 10 to 300 $m^2/g$ as measured by nitrogen BET.

6. The method of claim 1, wherein the nanoparticle compound is selected from iron, nickel, cobalt and magnetite.

7. The method of claim 1, further including maintaining a temperature of the liquid hydrocarbon stream following introduction of the nanoparticle compound at a similar temperature as prior to the introduction of the nanoparticle compound.

8. The method of claim 1, wherein the nanoparticle compound comprises magnetite, and the magnetic phase transition temperature is about 585° C.

9. The method of claim 1, wherein the nanoparticle compound is introduced to the liquid hydrocarbon stream to form a concentration of nanoparticle compound between about 0.1 weight % and 15 weight %.

10. The method of claim 1, further including a step of regenerating the nanoparticle compound following the separation step to remove the polar molecule contaminant adsorbed onto the nanoparticle compound.

11. The method of claim 10 wherein the step of regenerating the nanoparticle compound includes heating the nanoparticle compound-polar molecule complex at a temperature above about 250° C.

12. The method of claim 11 wherein the step of regenerating the nanoparticle compound includes heating the nanoparticle compound-polar molecule complex at a temperature above about 250° C. and below the magnetic phase transition temperature of the nanoparticle compound.

13. The method of claim 12 wherein the nanoparticle compound comprises magnetite, and the magnetic phase transition temperature is about 585° C.

14. The method of claim 10, wherein the step of regenerating the nanoparticle compound includes immersing the nanoparticle compound-polar molecule complex in water.

15. The method of claim 1, further including heating the nanoparticle compound prior to introducing the nanoparticle compound into the liquid hydrocarbon stream to increase the nanoparticle compound's capacity to remove polar molecule contaminants from the liquid hydrocarbon stream.

16. The method of claim 15, wherein the nanoparticle compound is heated at a temperature of at least about 250° C.

17. The method of claim 15, wherein the nanoparticle compound is heated at a temperature of at least about 350° C.

18. The method of claim 15, wherein the nanoparticle compound is heated at a temperature above about 250° C. and below the magnetic phase transition temperature of the nanoparticle compound.

19. The method of claim 18, wherein the nanoparticle compound comprises magnetite and the magnetic phase transition temperature is about 585° C.

* * * * *